US005195913A

United States Patent [19]

Shattuck

[11] Patent Number: 5,195,913

[45] Date of Patent: Mar. 23, 1993

[54] TERMINAL BLOCK HAVING IMPROVED TERMINAL CAVITY

[75] Inventor: Bradley A. Shattuck, Warren, Ohio

[73] Assignee: General Motors Corporation, Detroit, Mich.

[21] Appl. No.: 940,156

[22] Filed: Sep. 3, 1992

Related U.S. Application Data

[63] Continuation of Ser. No. 767,449, Sep. 30, 1991, abandoned.

[51] Int. Cl.[5] ..... H01R 13/432

[52] U.S. Cl. ..... 439/748; 439/246

[58] Field of Search ..... 439/246, 745–749, 439/252

[56] References Cited

U.S. PATENT DOCUMENTS

| | | | |
|---|---|---|---|
| 2,296,633 | 9/1942 | Falge | 439/748 |
| 3,047,831 | 7/1962 | Majewski | 439/748 |
| 3,267,410 | 8/1966 | Baer et al. | 439/680 |
| 3,311,867 | 3/1967 | Beauchaine | 439/748 |
| 3,980,385 | 9/1976 | Hirokawa et al. | 439/748 |
| 4,097,109 | 6/1978 | Cross | 439/622 |

*Primary Examiner*—Gary F. Paumen
*Attorney, Agent, or Firm*—William A. Schuetz

[57] ABSTRACT

A terminal block has terminal cavities housing female terminals having a side wall and vertically spaced, deflectable lock tangs that project rearwardly and outwardly. The terminal cavities have internal projection locks on their respective top and bottom walls that cooperate with the deflectable lock tangs to lock the female terminal in place. An axial rail depends from each of the top and bottom walls of the terminal cavities to divide wide axial slots leading to the internal projection locks into two narrow parallel slots that accommodate the cooperating lock tangs of the female terminal. The axial rails locate the female terminals vertically in the terminal cavities and also prevent improper insertion of male blade terminals between the female terminals and the top or bottom walls of the terminal cavities. Each terminal cavity also includes positioning ribs that project into the terminal cavity from each side wall to locate the female terminal laterally in the terminal cavity so that the lock tangs are properly disposed in the narrower slots where the axial rails do not interfere with the proper locking function of the lock tangs.

1 Claim, 3 Drawing Sheets

TERMINAL BLOCK HAVING IMPROVED TERMINAL CAVITY

This is a continuation of application Ser. No. 07/767,449 filed on Sep. 30, 1991, now abandoned.

BACKGROUND OF THE INVENTION

This invention relates generally to terminal blocks and more specifically to terminal blocks having terminal cavities for housing female terminals that are locked in the terminal cavities by lock tangs of the female terminals.

U.S. Pat. No. 4,097,109 granted to William E. Cross Jun. 27, 1978 discloses a terminal block having a plurality of terminal cavities extending through the terminal block that house female terminals of the type that is disclosed is U.S. Pat. No. 3,267,410 granted to Donald G. Baer et al Aug. 16, 1966. These types of female terminals have at least one lock tang that snaps over an internal lock projection in the terminal cavity to lock the female terminal in place upon insertion into the terminal cavity via a rear opening of the terminal cavity.

These terminal blocks are typically molded of a thermoplastic material in a mold using axial cores for forming the terminal cavities. The axial cores produce a wide axial slot for each internal lock projection in the terminal cavity that extends from a front opening of the terminal cavity to the respective internal lock projection. The wide axial slot or slots allow the front end of the female terminal to float in the vertical direction and also make it possible to mismatch the mating male blade terminal by inserting it between the female terminal and the terminal cavity wall associated with the internal lock projection rather than into the female terminal itself.

SUMMARY OF THE INVENTION

The object of this invention is to provide a terminal block having an improved terminal cavity that provides an internal lock projection for locking a female terminal in place as well as structure to locate the front end of the female terminal vertically more precisely.

A feature of the invention is that the terminal block has an axial rail associated with each internal lock projection that locates the front end of the female terminal vertically.

Yet another feature of the invention is that the terminal block has an axial rail in each slot associated with an internal lock projection that guides and supports the front end of the female terminal to position it vertically in the terminal cavity more precisely.

Still another feature of the invention is that the terminal block has an axial rail dividing each slot associated with an internal lock projection of the terminal cavity and at least one lateral positioning rib in the terminal cavity that assures proper positioning of the terminal lock tang in one of the narrower slots formed by the axial rail.

Still yet another feature of the invention is that the terminal block may have an improved terminal cavity that is configured to accommodate female terminals that have vertically spaced lock tangs.

Still yet another feature of the invention is that the terminal block may have an improved terminal cavity that is configured to accommodate female terminals that can be inserted in the terminal cavity right side up or upside down.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
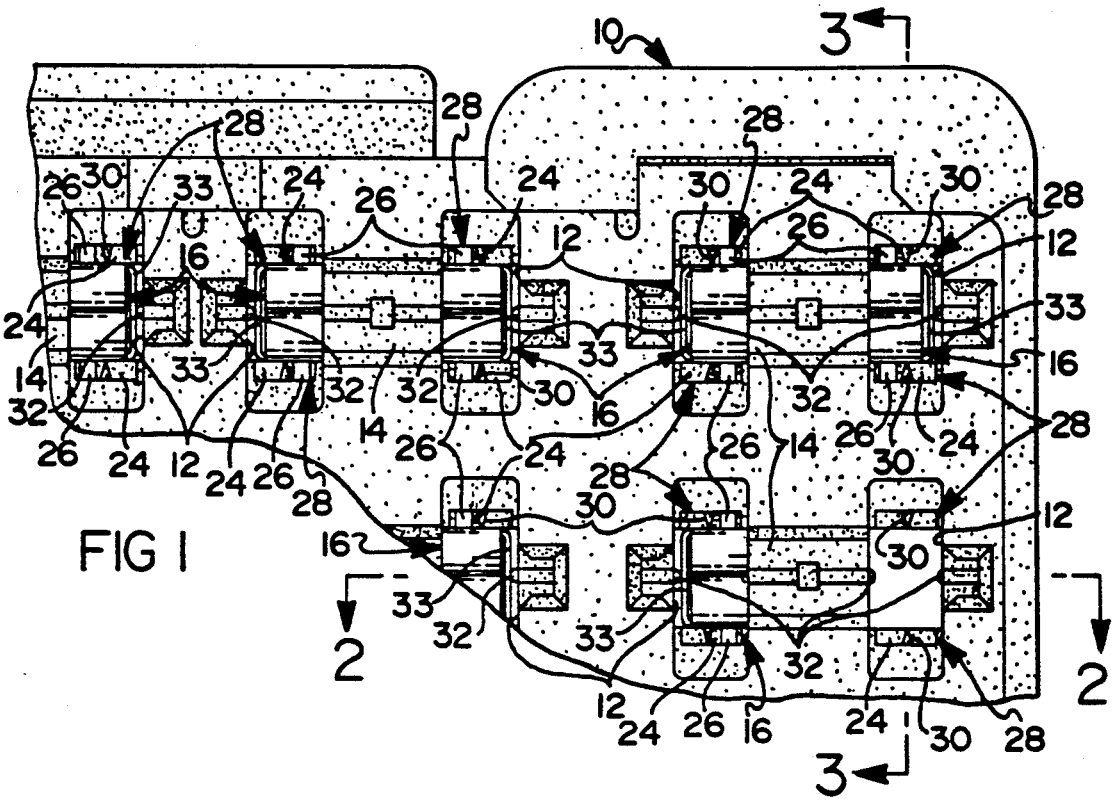
FIG. 1 is a fragmentary front view of a terminal block having terminal cavities in accordance with the invention.

Referring now to the drawing, a terminal or fuse block 10 having a plurality of terminal cavities 12 is illustrated. The fuse block 10 is molded of a suitable electrically insulative thermoplastic material and the terminal cavities 12 are arranged in pairs that open into sockets 14 in the front of the fuse block that are shaped for receiving fat fuses (not shown). Each terminal cavity 12 houses a female terminal 16 that is adapted to receive one of the male blade terminals of the flat fuse when it is plugged into one of the sockets 14. Each female terminal 16 is attached to the end of an insulated conductor wire 18 in a conventional manner using well known crimping techniques.

Each terminal cavity 12 extends through the terminal block 10 having a front opening 20 that opens directly into one of the socket 14 and a rear opening 22 by means of which the female terminal 16 is inserted into the terminal cavity 12.

Figure 4:
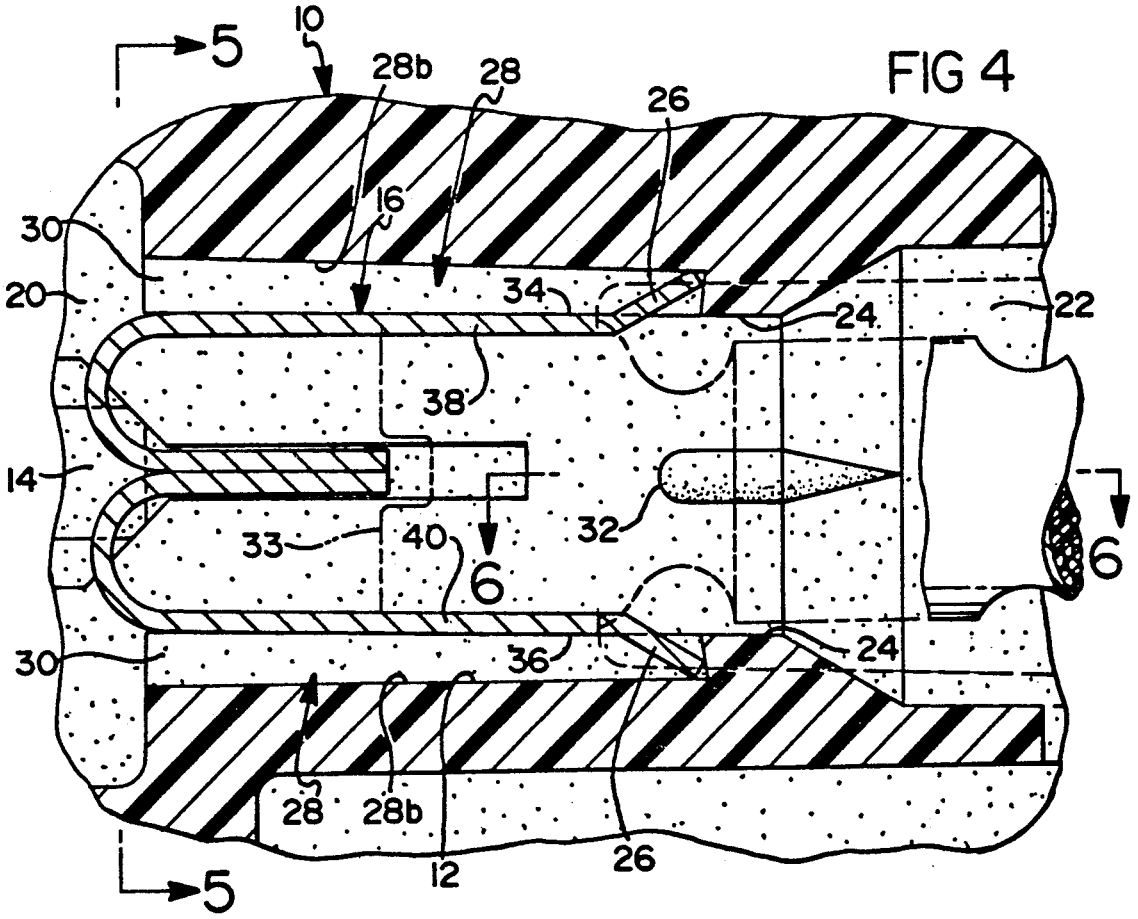
FIG. 4 is an enlargement of a portion of FIG. 3 substantially within the arrowed circle.

Each terminal cavity 12 also has an internal projection lock 24 associated with its respective top and bottom walls as best shown in FIG. 4. These projection locks have rearwardly facing ramps and undercut forwardly facing lock shoulders so that narrow, deflectable lock tangs 26 of the female terminal 16 snap over the projection locks 24 and cooperate with the forwardly facing shoulders to lock the female terminal 16 in place when it is inserted into the terminal cavity 12 through the rear opening 22.

The terminal block 10 is molded using axial cores to form the terminal cavities 12. These axial cores typically produce wide axial or longitudinal slots 28 in the top and bottom walls of the terminal cavity 12 that are associated with the respective internal projection locks 24. These wide axial slots 28 extend from the front opening 20 to the forwardly facing shoulders of the internal projection locks 24 as in the prior art terminal cavities. However, the terminal block 10 of this invention also includes axial rails 30 for each of the wide axial slots 28 that depend from the top and bottom walls of the improved terminal cavity 12 respectively. These axial rails 30 preferably extend for the full length of the wide axial slots 28 and divide each of the wide axial slots 28 into two narrower parallel slot 28*a* and 28*b* of equal width as best shown in FIG. 5.

The axial rails 30 guide the front end of the female terminal 16 during insertion and precisely locate the front end of the female terminal 16 in the vertical direction after insertion so that the flat fuses or other electrical devices plug into the terminal block 10 easily. The axial rails 30 also prevent improper insertion of the male blade terminals between the front end of the female terminal 16 and the slotted top or bottom walls of the terminal cavity 12.

Figure 5:
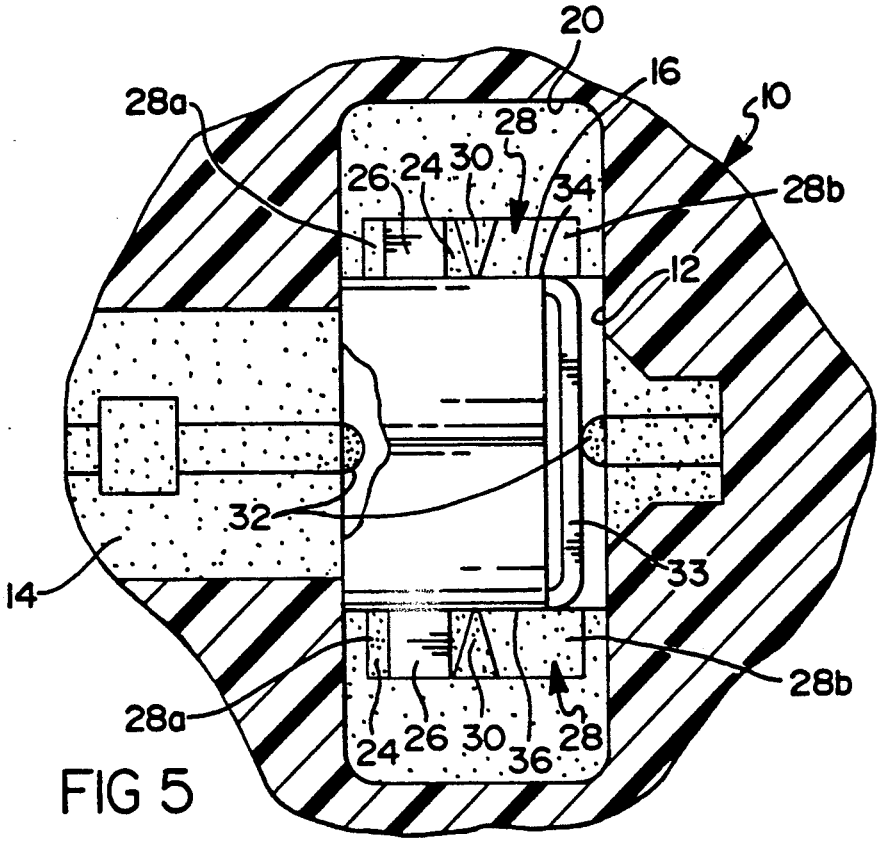
FIG. 5 is a section taken substantially along the line 5—5 of FIG. 4 looking in the direction of the arrows.
Figure 6:
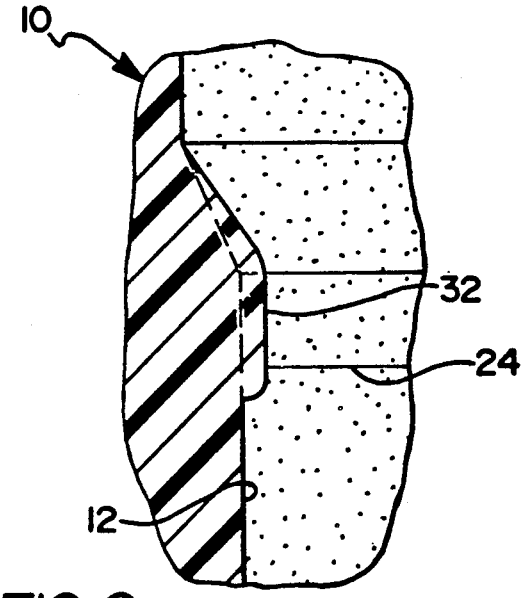
FIG. 6 is a section taken substantially along the line 6—6 of FIG. 4 looking in the direction of the arrows.

As stated above these axial rails 30 divide each of the wide axial slots 28 into two narrower parallel slots 28*a* and 28*b* of equal width as best shown in FIG. 5. Each of these narrower parallel slots 28*a* and 28*b* must accommodate the lock tang 26 of the female terminal 16. Consequently the female terminal 16 must also be located laterally in the terminal cavity 12 in a precise manner so that the axial rail 30 does not interfere with the proper functioning of the lock tang 26. To this end each terminal cavity 12 also includes at least one positioning rib 32 projecting into the terminal cavity 12 from a sidewall. In this particular instance a positioning rib 32 projects into the terminal cavity 12 from a side wall as best shown in FIGS. 4, 5 and 6. This accommodates the reversibility of the female terminal 16 as described below.

The female terminal 16 comprises a three sided body having a side wall 33 with upper and lower flanges 34 and 36 integrally attached to its upper and lower longitudinal edges. The upper and lower flanges support forwardly projecting arms 38 and 40 in cantilever fashion. These arms which form the front end of the female terminal are reversely bent to provide juxtaposed inner portions that form the female receptacle for receiving the male blade terminals of the flat fuses or other electrical devices that are plugged into the terminal block 10. The narrow deflectable lock tangs 26 mentioned earlier project rearwardly and outwardly from the rear edges of the respective flanges 34,36. The width of the lock tangs 26 is a little less than half the width of the flanges 34,36 and the lock tangs 26 are disposed entirely on one side of a vertical longitudinal plane bisecting the female terminal 16 at its three-sided body as best seen in FIGS. 1, 2 and 5.

Referring now to figure 5, the right hand positioning rib 32 engages the side wall 33 of the female terminal 16 during insertion, pushing the longitudinal edges of the flanges 34,36 and the forwardly projecting arms 38,40 toward and preferably up against the opposite side wall of the terminal cavity 12. This locates the front end of the female terminal 16 laterally in a precise manner and properly positions the lock tangs 26 in the narrower slots 28*a* where the longitudinal rails 30 do not interfere with the proper locking function of the lock tangs 26.

Figure 2:
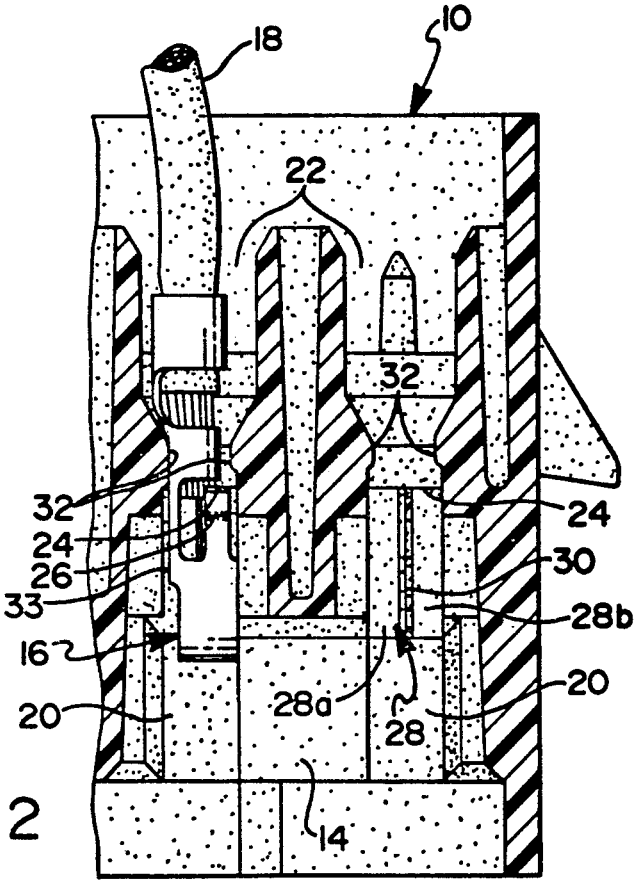
FIG. 2 is a section taken substantially along the line 2—2 of FIG. 1 looking in the direction of the arrows.
Figure 3:
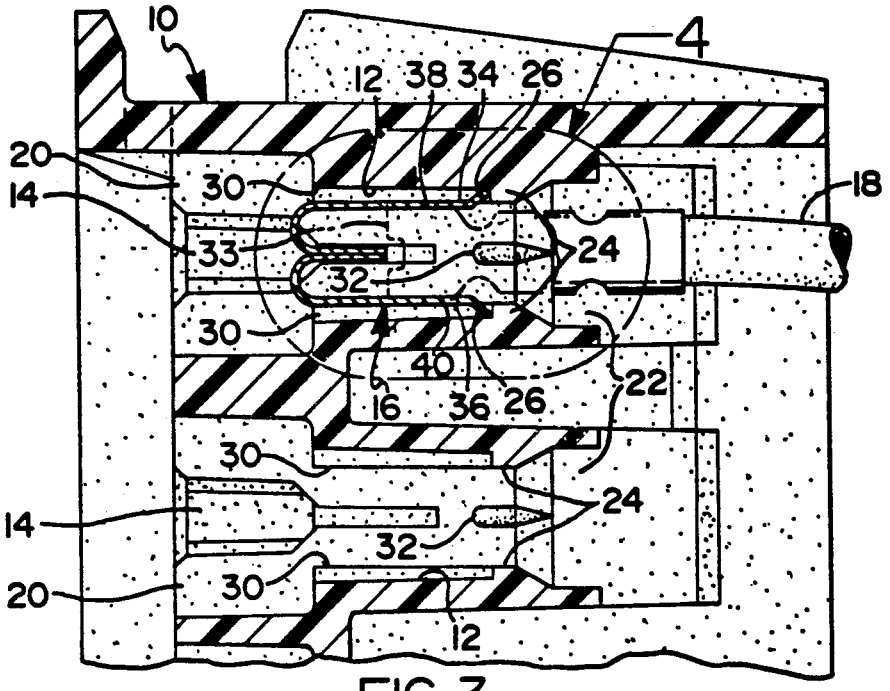
FIG. 3 is a section taken substantially along the line 3—3 of FIG. 1 looking in the direction of the arrows.

As indicated above, the female terminal 16 is reversible in the sense that it can be inserted into the terminal cavity 12 right side up as shown in FIGS. 3, 4 and 5 or it can inserted upside down as shown in the left hand terminal cavities of the terminal cavity pairs shown in FIGS. 1 and 2. In this case the side wall 33 is now engaged by the left hand positioning rib 32 to properly position the lock tangs 26 in the narrower slots 28*b*. This reversibility not only requires two positioning ribs 32 but also the two axial rails 30 dividing the wide axial slots 28 so that the narrower slots 28*a* and 28*b* also both accommodate the latch tangs 26. It should also be noted that the improved terminal cavity 12 accommodates female terminal 16 having two vertically spaced lock tangs 26 for a balanced retention.

I wish it to be understood that I do not desire to be limited to the exact details of construction shown and described, for obvious modifications will occur to a person skilled in the art.

The embodiments of the invention in which an exclusive property or privilege is claimed are defined as follows:

1. In a terminal block having a terminal cavity that houses a female terminal right side up or upside down in the terminal cavity, the female terminal being three sided and having a deflectable lock tang that projects rearwardly and outwardly, the terminal cavity extending through the terminal block and having a front opening for receiving a mating terminal blade and a rear opening by means of which the female terminal is inserted into the terminal cavity, the terminal cavity also having internal projection locks associated with its respective top and bottom walls that cooperate with the deflectable lock tang to lock the female terminal in place when it is inserted into the terminal cavity through the rear opening, the terminal block having wide axial slots in its respective top and bottom walls of the terminal cavity that are associated with the respective internal projection locks, the wide axial slots extending from the front opening of the terminal cavity to forwardly facing shoulders of the internal projection locks, the improvement comprising:

an axial rail that depends from each of the top and bottom walls of the terminal cavity to divide each of the wide axial slots into two narrower parallel slots each of which is sized to accommodate the cooperating lock tang of the female terminal, the axial rails engaging opposite sides of the female terminal along substantially the entire length of said opposite sides to locate the female terminal vertically in the terminal cavity, said rails also extending for the full length of said slots for locating the female terminal in the terminal cavity in the vertical direction more precisely and for preventing improper insertion of a mating blade terminal between the female terminal and the slotted top or bottom walls of the cavity, and positioning ribs that project into the terminal cavity from its side walls to locate the female terminal laterally in the terminal cavity so that the lock tang is properly disposed in one of the narrower slots where the longitudinal rails do not interfere with the proper locking function of the lock tang.

* * * * *